United States Patent [19]

Foster

[11] Patent Number: 4,940,229

[45] Date of Patent: Jul. 10, 1990

[54] TWO-LEGGED BABY SWING

[76] Inventor: Edwin E. Foster, 1801 Camp Craft Rd., Austin, Tex. 78746

[21] Appl. No.: 399,015

[22] Filed: Aug. 28, 1989

[51] Int. Cl.[5] ..... A63G 9/16

[52] U.S. Cl. ..... 272/86; 297/276

[58] Field of Search ..... 272/85, 86; 297/273–282

[56] References Cited

U.S. PATENT DOCUMENTS 3,806,117 4/1974 Foster .

4,181,299 4/1980 Foster .

4,240,625 12/1980 Meeker ..... 272/86

*Primary Examiner*—Richard E. Chilcot, Jr.

*Attorney, Agent, or Firm*—Kalish & Gilster

[57] ABSTRACT

A two-legged swing with a single swing arm, powered by a spring motor, which provides a simple structure for imparting rocking motion to the swing arm, for making the motor easily detachable, and for pivoting the swing seat. The invention involves a swing comprising a frame, a leg, a base, and a support structure. The leg has both upper and lower portions. The base is joined to the lower portion of the leg. The support structure is joined to the upper portion of the leg and has a coupling means. A swing arm hangs from the support structure and is capable of swinging movement by rotating axially about the support structure. Rocking means is connected to the swing arm by a single bracket for imparting rocking motion to the swing arm. The bracket has both upper and lower portions. The lower portion of the bracket is connected to an upper portion of the swing arm. The upper portion of the bracket has an opening and extends to opposite the coupling means. The rocking means is inserted through the opening of the bracket into the coupling means, such that the portion of the rocking means in the bracket is moving portion and the portion of the rocking means coupled to the support structure is a stationary portion.

17 Claims, 3 Drawing Sheets

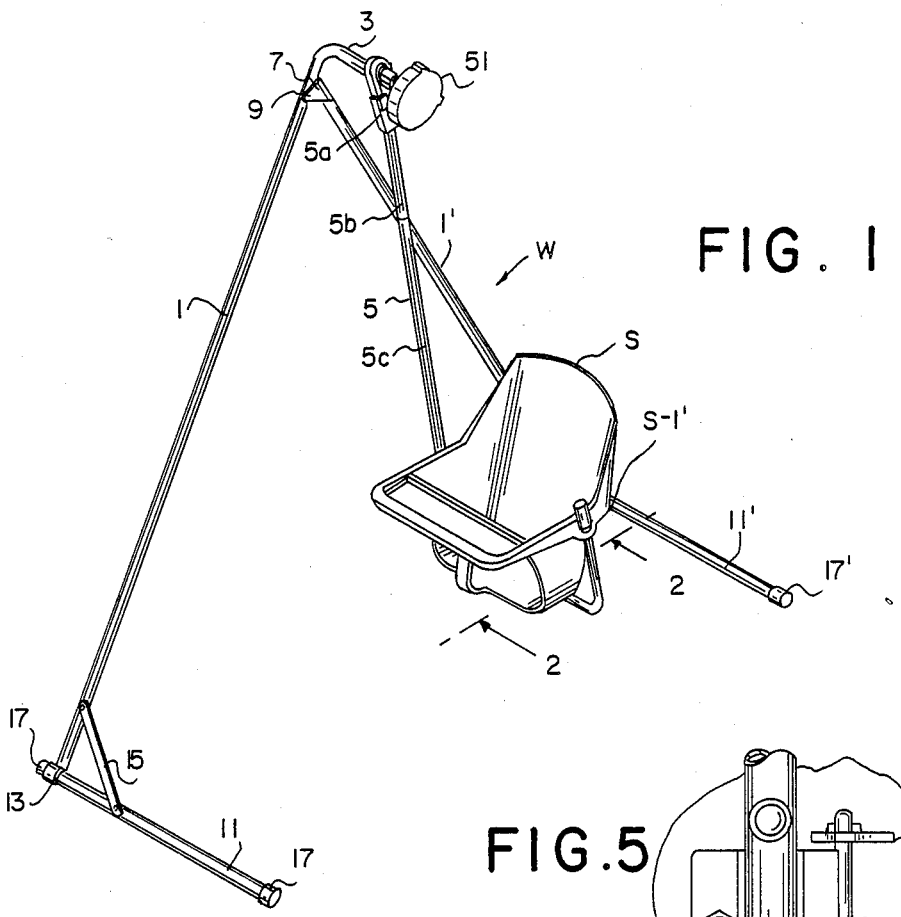
FIG. 1
FIG. 5
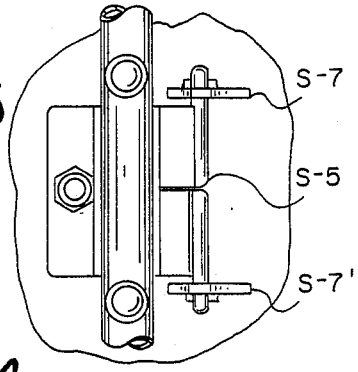
FIG. 2
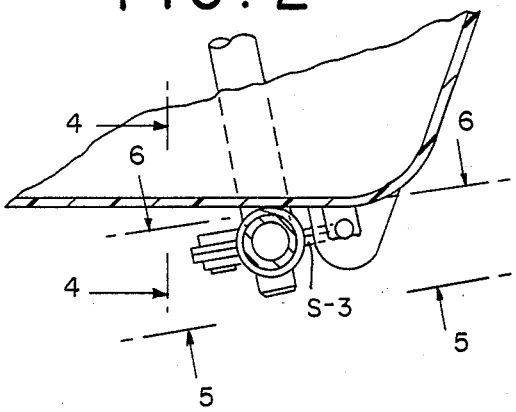
FIG. 4
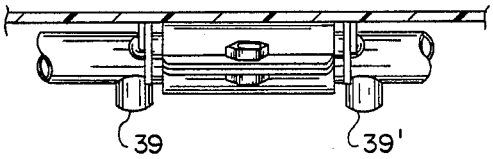
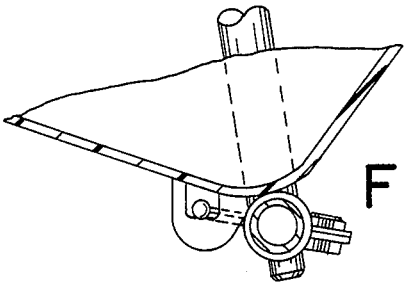
FIG. 3
FIG. 6
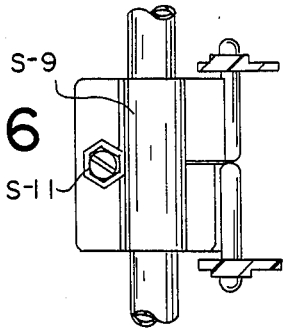

TWO-LEGGED BABY SWING

BACKGROUND AND SUMMARY OF THE INVENTION

This invention relates in general to swings and, more particularly, to two-legged swings with a single swing arm, powered by a spring motor, but which provides a simple structure for imparting rocking motion to the swing arm, for making the motor easily detachable, and for pivoting the swing seat.

Demonstrative of the state of the art are the patents to Foster, U.S. Pat. Nos. 3,806,117 and 4,181,299. The former teaches a two-legged swing, but does not provide the advantage of a readily replaceable swing motor assembly, nor of a simple coupling means between the swing motor and the swing arm. The latter teaches a detachable motor, but it is incorporated into a four-legged swing with two swing arms. The motor is coupled to both a swing arm and a swing bar which is in the space between the legs. Further, neither patent provides the advantage of a swing seat which can be pivoted.

Therefore, among several objects of the invention may be noted the provision of a simple mechanism for imparting rocking motion in a two-legged swing; the provision of such a mechanism which allows the rocking means to be easily detached for service or replacement; which results in a reduction of the number of parts required; and which is easy and relatively inexpensive to manufacture and maintain; and the provision of a swing seat that can be pivoted into either a horizontal or a reclining position.

Briefly, the invention involves a swing comprising a frame, a leg, a base, and a cantilevered support structure. The leg has both upper and lower portions. The base is joined to the lower portion of the leg. The support structure is joined to the upper portion of the leg and has a coupling means at a distal end. A swing arm hangs from the support structure from a center of rotation located anteriorly of the leg means without need for additional leg structure anteriorly of the center of rotation and is capable of swinging movement by rotating axially about the support structure. Rocking means, namely a spring motor is connected to the swing arm by a single bracket anteriorly of the support structure and the swing arm for imparting rocking motion to the swing arm. The bracket has both upper and lower portions. The lower portion of the bracket is connected to an upper portion of the swing arm. The upper portion of the bracket has an opening and extends to opposite the coupling means. The spring motor has an operating shaft anteriorly of the bracket inserted through the opening of the bracket into the coupling means, such that the portion of the shaft in the bracket is a moving portion and the portion of the shaft coupled to the support structure is a stationary portion.

BRIEF DESCRIPTION OF THE DRAWINGS

FIG. 1 is a perspective view of a spring powered swing constructed in accordance with and embodying the present invention.

FIG. 2 is an enlarged fragmentary horizontal transverse view taken line 2—2 of FIG. 1.

FIG. 3 is a similar fragmentary view of the structure of FIG. 2, take the opposite direction.

FIG. 4 is a vertical transverse sectional view taken on the line 4—4 of 2.

FIG. 5 is a fragmentary bottom view taken on the line 5—5 of FIG. 2.

FIG. 6 is a fragmentary horizontal transverse sectional view taken on line 6—6 of FIG. 2.

DESCRIPTION OF THE PREFERRED EMBODIMENTS

Figure 7:
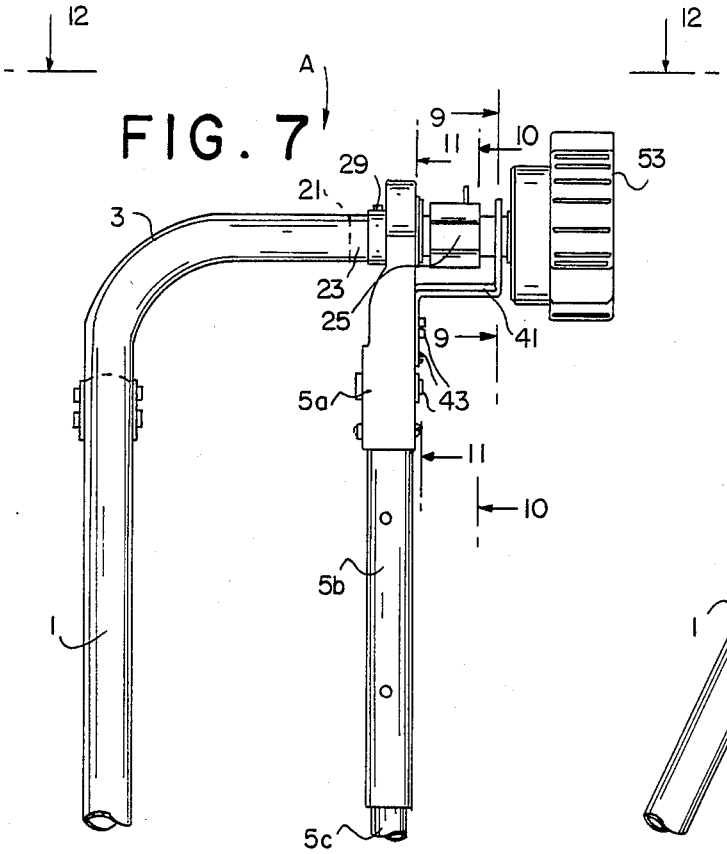
FIG. 7 is an enlarged perspective view of the support structure, bracket, swing arm, and motor.
Figure 8:
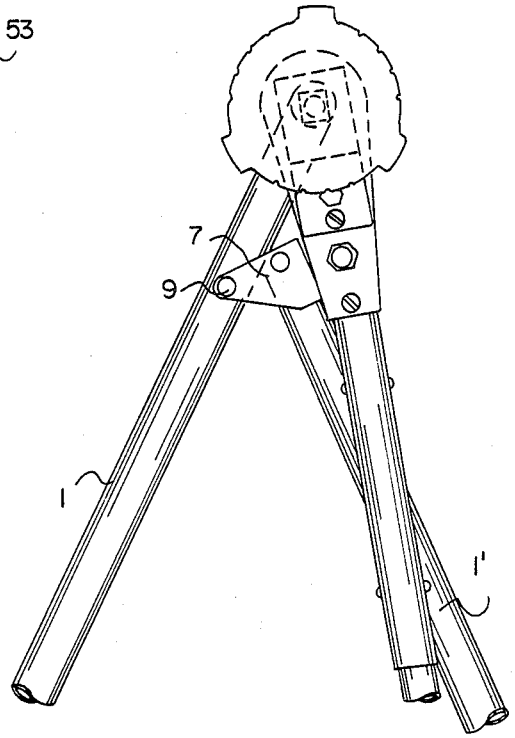
FIG. 8 is a side view of FIG. 7.
Figure 9:
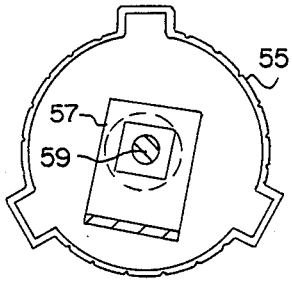
FIG. 9 is a fragmentary vertical transverse sectional view taken on the line 9—9 of FIG. 7.
Figure 10:
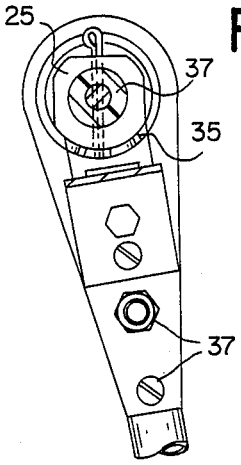
FIG. 10 is a fragmentary vertical transverse sectional view taken on the 10—10 of FIG. 7.
Figure 11:
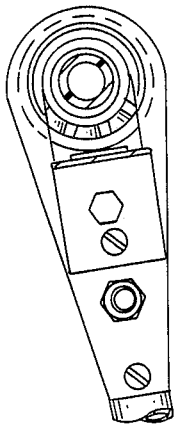
FIG. 11 is a fragmentary vertical transverse sectional view taken on the line 11—11 of FIG. 7.
Figure 12:
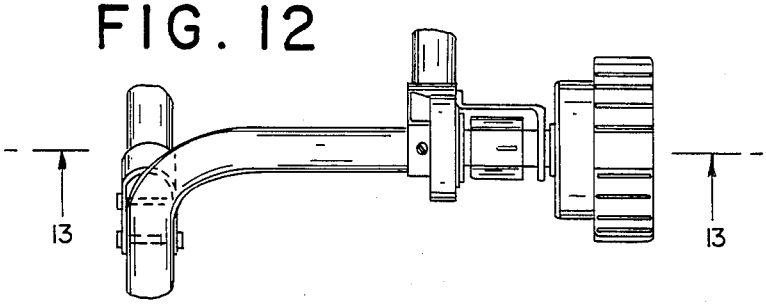
FIG. 12 is a fragmentary top plan view of the structures in FIG. 7.
Figure 13:
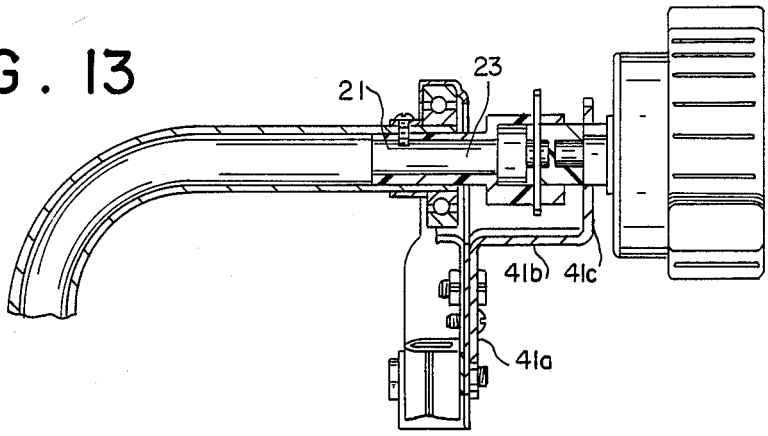
FIG. 13 is a fragmentary horizontal transverse view taken on the line 13—13 of FIG. 12.
Figure 15:
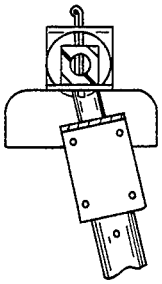
FIG. 15 is a fragmentary vertical transverse sectional view taken on the line 15—15 of FIG. 14.
Figure 14:
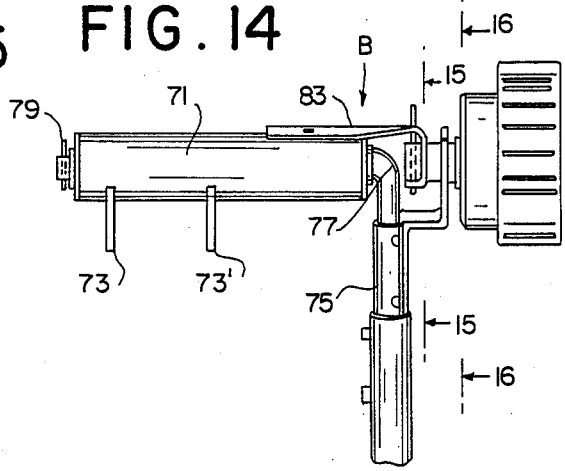
FIG. 14 is an enlarged perspective view of another version B of the structures of FIG. 7.
Figure 16:
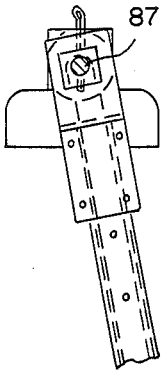
FIG. 16 is a fragmentary vertical transverse sectional view taken on the line 16—16 of FIG. 14.
Figure 17:
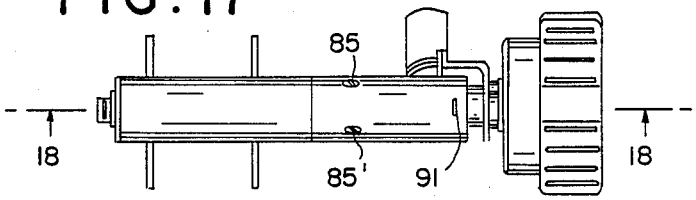
FIG. 17 is a fragmentary top plan view of the structures in FIG. 14.
Figure 18:
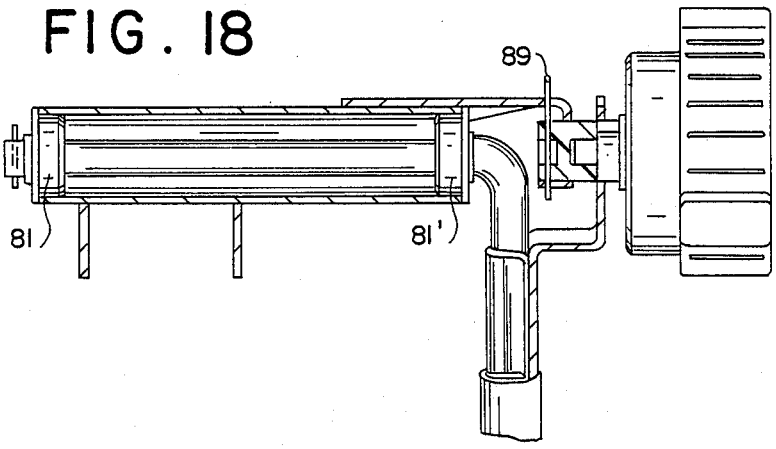
FIG. 18 is a fragmentary horizontal transverse view taken on the line 18—18 of FIG. 17.

Referring by reference characters to the drawings which illustrate the preferred embodiment of the present invention, W in FIG. 1 designates a swing of the two-legged type designed primarily for infant use. Swing W incorporates a single bracket for imparting rocking motion to a swing arm, a support structure for detachably holding a rocking means, broadly referred to as A and B in FIGS. 7–13 and 14–18 respectively, and a hinged fitting for pivoting a swing seat.

In FIG. 1, which shows version A, leg 1 is longer than leg 1', leg 1' is straight and leg 1 has a lateral, i.e., a cantilevered extension 3 which serves as a support structure for a swing arm 5. An upper portion of leg 1' and an upper portion of leg 1 just below the lateral extension 3 are joined by means of a suitable hinged fastening device 7 with a bolt 9 passing through leg 1. In this manner, the legs are collapsible. Maximum extension is reached when leg 1 rests against the top of leg 1', so as to form approximately an inverted V-shape. The legs are fabricated preferably of tubular hollow metal stock to provide sturdiness and yet be lightweight enough for ease of transport.

The lower portion of each leg is joined to a base 11, 11' both by fasteners 13, 13' and by reinforcement brackets 15, 15'. The bases, fabricated from similar materials as the legs, extend substantially perpendicular to a plane defined by the legs, both bases projecting to the same side of the plane. The ends of the bases are capped by rubber grip members 17, 17'.

The support structure, which in version A is the lateral extension 3 of leg 1, projects anteriorly to the same side of the legs as the bases 11, 11', and is less than half their length. The support structure ends in a coupling means. In version A, the coupling means is a spacer sleeve 21 consisting of a tubular body 23 and a flange 25 with a semi-circular and semi-octagonal cross-section and an opening 27. Body 23 of sleeve 21 is inserted into support structure 3. Flange 25, being larger, remains outside support structure 3. Sleeve 21 can be adjusted and extended and is held in place by a fastening device, for instance, a screw 29 through a hole in the top of the support structure 3. Screw 29 then presses upon body 23 of sleeve 21.

A swing arm 5 hangs from support structure, anteriorly of the plane of legs 1, 1', 3 and consists of upper, middle, and lower portions 5*a*, 5*b*, and 5*c*, respectively. In version A, swing arm 5 is positioned between sleeve fastening device 29 and sleeve flange 25. Upper portion of the swing arm 5*a* is a fitting 31 surrounding a ring 33 which is around support structure 3 (see FIGS. 7, 10, 11) and so defining a center of rotation for the swing arm and thus also a horizontal axis of rotation lying within support structure 3. Between ring 33 and support structure 3 are ball bearings 35. This fitting, ring, and ball bearing arrangement allows the swing arm to swing by rotating axially about the support structure.

Middle portion of the swing arm 5*b* is a shaft inserted into upper portion 5*a* and connected by screws 37 or other suitable means. Lower portion of the swing arm 5*c* is inserted into middle portion 5*b* so its height is adjustable and so it can swivel. Lower portion 5*c* is made of a stain and corrosion resistant material such as stainless steel and is J-shaped, with the bottom of the J flattened.

A swing seat S, made of a durable material, preferably hardened plastic, is connected in two ways to lower portion of the swing arm 5*c*. First, the arm, before and after the flattened part of the J, passes through holes S-1, S-1', on either side of the swing seat S. Second, seat S is connected to the flattened part of the J by a hinged fitting S-3 on its underside, as shown in FIGS. 2–6. Fitting S-3 is attached to seat S by a hinge S-5 through two flanges S-7, S-7' which are molded to the seat. Fitting S-3 consists of a cylindrical body S-9 closed by, for instance, a screw S-11. Cylindrical body S-9 is around lower portion of the swing arm 5*c* in such a way that it can pivot about the arm, so that seat S can be either horizontal (see FIG. 2) or reclining (see FIG. 3). Lateral movement of hinged fitting S-3 is prevented by bolts or screws 39, 39' through the swing arm on either side of the fitting.

Rocking motion is imparted to the swing arm by way of a single bracket 41. The bracket consists of upper, middle, and lower portions, 41*a*, 41*b*, and 41*c* respectively. Lower portion of the bracket 41*c* is connected to the upper portion of the swing arm 5*a* by several screws 43 or other suitable means. Middle portion of the bracket 41*b* projects at a right angle from upper portion of the swing arm 5*a*, underneath sleeve flange 25. Upper portion of the bracket 41*a* is at a right angle to middle portion 41*b* and extends upward to opposite sleeve flange 25. Bracket 41 contains an opening 47 which is directly opposite flange opening 27 or whatever other coupling means is used. Flange opening 27 and bracket opening 47 are approximately the same size.

A rocking means 51 is attached to the swing by inserting it through bracket opening 47 and into the coupling means, such that the portion of the rocking means in the bracket is a moving portion and the portion of the rocking means coupled to the support structure is a stationary portion. In the preferred embodiment, the rocking means is a hand-turned spring loaded motor of a commercially available type, with a spring mechanism inside a body 53, a winding knob 55, and two extensions, a moving portion 57, and a stationary portion 59 (see FIGS. 9, 12). The motor is held into sleeve flange 25 by a suitable fastening device, for example, a cotter pin 61 which passes through holes in sleeve flange 25 and stationary part of the motor 59. This method of attachment allows the motor to be removable and thus replaceable if there is any problem with the motor. Although the preferred embodiment has a motor with a stationary extension inserted into a flange opening, it is conceivable that a different type of motor with, for instance, a recess or opening in its stationary portion could be attached by a coupling means which is an extension rather than a flange with an opening.

In version B, shown in FIGS. 14–18, the support structure is an independent structure, rather than being the upper portion of one of the legs, while still extending in cantilevered horizontal orientation anteriorly of legs 1, 1'. The swing arm is also different in order to accommodate the different support structure. The support structure of version B consists of a hollow cylindrical casing 71 preferably of the same material as the legs. Spot-welded perpendicular to the underside of casing 71 are two fittings 73, 73' to which the legs 1, 1' are joined so as to be collapsible. In this version, both legs 1, 1' are straight and of equal length.

The upper portion of the swing arm, rather than being a fitting, ring, and ball bearing arrangement, is an L-shaped piece 75, with a rounded elbow 77, and is narrower than middle portion of the swing arm 5*b*. Piece 75 is inserted into and through casing 71, fastened at the far end by, for instance, a cotter pin 79. The swing arm is inserted in such a way as to allow it to rotate axially within the casing. In the preferred embodiment, the arm is inserted through flanges 81, 81' at both ends of casing 71, which keep the arm away from the walls of casing 71.

Since the swing arm is inserted into the support structure, there is no room for a spacer sleeve and flange. Therefore, coupling is provided by a member 83 joined to the top of casing 71 by two screws 85, 85' although it could also be joined by, for instance, spot-welding. Member 83 arches slightly above elbow 77 and extends beyond the end of casing 71. The end of member 83 is in line with casing 71, between the swing arm and bracket opening 47, and contains an opening 87 approximately the size of bracket opening 47. The end of member 83 also has a lower lip 89 projecting back towards the casing 71. The top of member 83 and lower lip 89 each contain a hole, and rocking means 51 is held in place by, for instance, a cotter pin 91 through these holes and through the holes in stationary part of the rocking means 59. All other features of version B, including its advantages and novelty over previous inventions, are the same as version A.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A self-rocking, spring-powered swing comprising a frame, the frame having leg means, a base, and a support structure, the leg means having both upper and lower portions, the base joined to the lower portion of the leg means, the support structure joined to the upper portion of the leg means for being supported by the leg means anteriorly thereof in cantilevered relationship to the leg means, the support structure having a coupling means, a swing arm hanging from the support structure from a center of rotation located anteriorly of the leg means without need for additional leg structure anteriorly of the center of rotation, the swing arm being capable of swinging movement about the center of rotation by rotating axially about the support structure, a spring motor connected to the swing arm by a single bracket anteriorly of the support structure and the swing arm for imparting rocking motion to the swing arm, the bracket having both upper and lower portions, the lower portion of the bracket being connected to an upper portion of the swing arm, the upper portion of the bracket having an opening and extending to opposite the coupling means, and the spring motor being inserted anteriorly of the bracket through the opening of the bracket into the coupling means, such that the portion of the spring motor in the bracket is a moving portion and the portion of the spring motor coupled to the support structure is a stationary portion.

2. A swing as defined in claim 1 and further characterized by a spacer sleeve for the coupling means, the sleeve being inserted into the support structure, the sleeve having an opening approximately the size of the bracket opening, the sleeve being capable of adjustment and extension, the sleeve being held in place by a fastening device through a hole in the top of the support structure, and the spring motor having an operating shaft inserted through the opening of the bracket into the opening of the sleeve, the support structure being a horizontal tubular member within which extends an axis of rotation, the center of rotation lying on the axis of rotation in a distal end of the tubular member, the moving and stationary portions of the spring motor being mutually coaxial and also coaxial with the axis of rotation.

3. A swing as defined in claim 1, the leg means comprising a pair of legs, and further characterized by the support structure being a lateral extension of the upper portion of one of the legs.

4. A swing as defined in claim 1 and further characterized by the upper portion of the swing arm being a ring which fits around the support structure in journalled relation thereto.

5. A swing as defined in claim 4 and further characterized by bearings located between the ring and the support structure.

6. A swing as defined in claim 1 and further characterized by the support structure being a hollow cylindrical casing.

7. A swing as defined in claim 6 and further characterized by a member joined to the top of the casing which extends beyond the end of the casing, the end of the member being in line with the casing, and containing an opening which serves as the coupling means.

8. A swing as defined in claim 6 and further characterized by the swing arm being L-shaped and being inserted into and through the casing with enough room inside the casing to enable the arm to rotate axially.

9. A swing as defined in claim 1 and further characterized by the rocking means being detachable by being attached by a fastening device commonly through an opening presented in the coupling means and a corresponding opening presented in the stationary portion of the rocking means.

10. A swing as defined in claim 1 and further characterized by the rocking motor being a ratcheting motor.

11. A swing as defined in claim 10 and further characterized by the spring motor being a hand-turned spring loaded motor.

12. A swing as defined in claim 1 and further characterized by a swing seat connected to the swing arm.

13. A swing as defined in claim 12 and further characterized by the seat connection being a hinged fitting attached in such a way that the seat can pivot about the arm, so that the seat can be either horizontal or reclining.

14. A swing as defined in claim 1 and further characterized by the leg means being constituted by a pair of legs and corresponding bases, the legs being joined at their upper portions so as to form approximately an inverted V-shape, the bases being joined to the lower portion of each leg, each base being an extension substantially perpendicular to a plane defined by the legs, both bases projecting anteriorly to the same side of the plane, the support structure projecting to the same side of the legs as the bases, the support structure being shorter than the bases.

15. A swing as defined in claim 14 and further characterized by the legs being pivotally joined so as to be collapsible by relative pivotal movement.

16. A self-rocking, spring-powered swing of the two-legged type comprising a frame, the frame having two legs, base structure at the lower ends of the legs, and a support structure, the legs having both upper and lower portions, the legs joined at their upper portions so as to form approximately an inverted V-shape, the base structure being joined to the lower portion of each leg, the base structure extending substantially perpendicular to a plane defined by the legs and projecting anteriorly of the plane, the support structure being a lateral extension of the upper portion of one leg for being supported anteriorly thereof in cantilevered relationship to said one leg, the support structure projecting to the same side of the legs as the base structure, being shorter than the base structure, and having a coupling means, a swing arm hanging from the support structure from a center of rotation located anteriorly of the leg means without need for additional leg structure anteriorly of the center of rotation, the swing arm being capable of swinging movement by rotating axially about the support structure, a swing motor connected to the swing arm by a single bracket anteriorly of the support structure and the swing arm for imparting rocking motion to the swing arm, the bracket having both upper and lower portions, the lower portion of the bracket being connected to an upper portion of the swing arm, the upper portion of the bracket having an opening and extending to opposite the coupling means, the coupling means being a spacer sleeve inserted into the support structure, the sleeve having an opening approximately the size of the bracket opening, the sleeve being capable of adjustment and extension, the sleeve being held in place by a fastening device through a hole in the top of the support structure, the spring motor being anterior of the bracket and having an operating shaft inserted through the opening of the bracket into the opening of the sleeve, such that a portion of the operating shaft in the bracket is a moving portion and a portion of the operating shaft in the sleeve is a stationary portion.

17. A self-rocking, spring-powered swing of the two-legged type comprising a frame, the frame having two legs, base structure at the lower ends of the legs, and a support structure, the legs having both upper and lower portions, the bases being joined to the lower portion of each leg, the base structure extending substantially perpendicular to a plane defined by the legs and projecting anteriorly of the plane, the support structure being a hollow cylindrical casing to which both legs are attached at their upper portions so as to form approximately an inverted V-shape, the support structure projecting anteriorly to the same side of the legs as the base structure, being shorter than the base structure and having a coupling means, a swing arm hanging from the support structure from a center of rotation located anteriorly of the leg means in a distal portion of the support structure without need for additional leg structure anteriorly of the center of rotation, the swing arm being inserted into and through the casing with enough room inside the casing to enable the arm to rotate axially, a spring motor connected to the swing arm by a single bracket anteriorly of the support structure and the swing arm for imparting rocking motion to the swing arm, the bracket having both upper and lower portions, the lower portion of the bracket being connected to an upper portion of the swing arm, the upper portion of the bracket having an opening and extending to opposite the coupling means, the coupling means being a member joined to the top of the casing which extends beyond the end of the casing, the end of the member being in line with the casing, and containing an opening approximately the size of the bracket opening, the spring motor being anterior of the bracket and having an operating shaft inserted through the opening of the bracket into the opening of the member, such that a portion of the operating shaft in the bracket is a moving portion and the portion of the rocking means in the member is a stationary portion.

* * * * *